US005907304A

United States Patent [19]

Wilson et al.

[11] Patent Number: 5,907,304

[45] Date of Patent: May 25, 1999

[54] LIGHTWEIGHT ANTENNA SUBPANEL HAVING RF AMPLIFIER MODULES EMBEDDED IN HONEYCOMB SUPPORT STRUCTURE BETWEEN RADIATION AND SIGNAL DISTRIBUTION NETWORKS

[75] Inventors: Steven E. Wilson, West Melbourne; James B. Nichols, Indialantic; Gary A. Rief, Melbourne; David M. Holaday, Indialantic; Walter M. Whybrew; Donald J. Beck, both of Palm Bay; Brett A. Pigon; Kelly V. Hillman, both of Palm Bay; Erik Granholm, Melbourne Beach, all of Fla.

[73] Assignee: Harris Corporation, Melbourne, Fla.

[21] Appl. No.: 08/781,530

[22] Filed: Jan. 9, 1997

[51] Int. Cl.[6] ..... H01Q 1/38

[52] U.S. Cl. ..... 343/700 MS; 343/853; 343/906

[58] Field of Search ..... 343/700 MS, 853, 343/893, 872, 906; H01Q 1/38

[56] References Cited

U.S. PATENT DOCUMENTS

| | | | |
|---|---|---|---|
| 4,477,813 | 10/1984 | Weiss | 343/700 MS |
| 4,924,236 | 5/1990 | Schuss et al. | 343/700 MS |
| 5,160,936 | 11/1992 | Braun et al. | 343/700 MS |
| 5,206,655 | 4/1993 | Caille et al. | 343/700 MS |
| 5,325,103 | 6/1994 | Schuss | 343/700 MS |
| 5,488,380 | 1/1996 | Harvey et al. | 343/853 |

*Primary Examiner*—Hoanganh Le
*Assistant Examiner*—Tan Ho
*Attorney, Agent, or Firm*—Charles E. Wands

[57] ABSTRACT

A modular antenna architecture includes a plurality of joined-together flat, laminate-configured antenna sub-panels, in which RF signal processing (RF amplifier) modules are embedded within a very lightweight, honeycomb-configured support member, upon which respective antenna sub-array and control, power and beam steering signal distribution networks are respectively mounted. The thickness of the honeycomb-configured support member-embedded is sized relative to the lengths of the RF signal processing modules such that input/output ports at opposite ends of the RF modules are substantially coplanar with conductor traces on the front and rear facesheets, so that the RF modules provide the functionality of RF feed-throughs to provide RF signal coupling connections between the rear and front facesheets of the antenna sub-panel.

22 Claims, 5 Drawing Sheets

LIGHTWEIGHT ANTENNA SUBPANEL HAVING RF AMPLIFIER MODULES EMBEDDED IN HONEYCOMB SUPPORT STRUCTURE BETWEEN RADIATION AND SIGNAL DISTRIBUTION NETWORKS

FIELD OF THE INVENTION

The present invention relates in general to planar array antenna systems, and is particularly directed to a new and improved lightweight modular antenna architecture for airborne and space-deployable applications, in which RF signal processing modules are embedded within a generally flat surfaced lightweight 'honeycomb' support structure, opposite sides of which support respective facesheets carrying patch antenna sub-arrays, and control, power and beam steering signal distribution networks.

BACKGROUND OF THE INVENTION

Modular planar array antenna architectures, such as those intended for spaceborne and airborne applications, are typically comprised of a plurality of mutually adjoining relatively thin, tile or brick-configured, solid metallic (e.g., quarter inch thick aluminum) plates, an individual one of which is diagrammatically shown at 10 in FIG. 1 and a joined-together array of which is shown in plan in FIG. 2. As shown in FIG. 1, a respective plate 10 includes an outer or front surface 11 upon which a plurality of antenna elements 14 are mounted. Signal processing and beam forming circuitry 15 is distributed over and mounted to a rear surface 12 of the plate 10, and is coupled to the antenna elements 14 on the plate's front surface by means of feed-through sections of RF transmission line 13, which pass through bores 16 in the plate 10, proper.

One of the major drawbacks to this solid plate-configured architecture is the substantial weight penalty of using solid metal plate to provide the requisite stiffness and strength. Solid aluminum plate, for example, has a weight density on the order of 170 lb./ft$^3$. In addition, a substantial amount of rear plate surface real estate and an associated complex component layout are required to support the RF signal processing (amplifier and impedance/phase control) and distribution (beam-forming) circuitry components 15. Further, the need to provide respective impedance-matching transmission line feed elements through bores in the plate 10 for coupling the circuitry components 15 on the rear surface 12 to the antenna elements 14 on the front surface 11 increases the complexity of the overall layout and tile assembly.

SUMMARY OF THE INVENTION

In accordance with the present invention, such deficiencies of such conventional high weight density, plate-configured antenna tile structures are effectively overcome by a new and improved lightweight modular antenna architecture, that is formed of a plurality of adjoining generally flat, lightweight honeycomb-laminate configured antenna sub-panels. Each sub-panel is sized to accommodate therein a plurality of RF signal processing modules, opposite terminal ends are connected to respective patch antenna sub-array and control, power and beam steering signal distribution networks mounted on respective facesheets that are adhesively bonded to opposite surfaces of an antenna sub-panel's interior honeycomb support member, so as to form a structurally stable laminate sub-panel architecture.

More particularly, a respective laminate-configured antenna sub-panel of the present invention comprises a generally flat front facesheet having an outer surface, on which an array of antenna elements (such as, but not limited to stub-tuned, proximity-fed, stacked patch elements) is mounted. An inner surface of this front facesheet is (adhesively) bonded to one side of a very lightweight, intermediate support member, preferably formed as a honeycomb-configured 'backbone' structure, having generally flat opposite parallel surfaces. Similarly, an inner surface of a rear facesheet, upon which the signal distribution network components are mounted, is adhesively bonded to the other side of the intermediate honeycomb-configured support member.

Because the intermediate support member is formed as a honeycomb-configured structure, it is generally hollow, and therefore has a very low weight density, particularly in comparison with that of the solid aluminum plate structure of the prior art, referenced above. As a non-limiting example, the honeycomb-configured intermediate support member may have a weight density on the order of only two pounds per cubic foot, which is nearly two orders of magnitude lighter than that of the prior art aluminum plate architecture, described above.

Bonding a pair of substantially rigid facesheets to the opposite surfaces of the honeycomb support member results in a relatively stiff, thermally stable modular sub-panel architecture that supports: 1—the antenna array on the outer surface of the front facesheet; 2—signal processing (RF amplifier) modules within the confines of the honeycomb support member; and 3—the feed distribution network on the outer surface of the rear facesheet.

To retain the respective RF signal processing (amplifier and phase/amplitude control) modules, the intermediate honeycomb-configured support member has a plurality of slots, which extend between its opposite sides to which the front and rear facesheets are bonded. Since the RF signal processing modules are installed within the honeycomb structure, rather than on an outer sub-panel surface, the integration density of the sub-panel is substantially enhanced, so as to facilitate joining a respective sub-panel with other like sub-panel laminate structures, to provide an overall antenna spacial configuration that defines a prescribed antenna aperture.

The thickness of the honeycomb support member is sized in accordance with the lengths of the RF signal processing modules, so that input/output ports at opposite ends of the RF modules are substantially coplanar with the front and rear facesheets. This sizing mutuality effectively minimizes signal interconnection distances at the input/output ports of the RF modules with the antenna elements and the signal processing components on the front and rear facesheets, so as to optimize impedance matching and minimize RF module insertion loss. In effect, the RF modules themselves provide the functionality of RF feed-throughs for RF signal coupling connections between the rear and front facesheets of a respective antenna sub-panel.

The RF module retention slots in the intermediate honeycomb support member are arranged in correspondence with the locations of the antenna elements on the front facesheet, so that antenna feed terminals at first ends of the RF modules extend through associated holes in the front facesheet, and thereby facilitate RF ribbon bond connections with feed terminals of the antenna elements. These ribbon bond connections have a slight arched contour so as to absorb both thermal and vibrational loads, while affording the requisite impedance matching properties for RF interconnect.

Such ribbon bond connections may be readily effected by means of a system level-associated, thermosonic ribbon bonding process, such as that described in copending U.S. patent application Ser. No. 08/781,541, by D. Beck et al, entitled: "High Frequency, Low Temperature Thermosonic Ribbon Bonding Process for System-Level Applications," filed on even date herewith, assigned to the assignee of the present application and the disclosure of which is herein incorporated.

The rear facesheet, which is bonded to the rear surface of the intermediate honeycomb support member, supports a plurality of interconnect substrates (e.g., printed wiring boards) that contain beam-forming and signal distribution networks and additional (multilayer) wiring substrates, which contain DC power and digital control links. Not only do the interconnect substrates serve to distribute signals with respect to the RF modules, but they provide additional layers of laminate material, augmenting rigidity and stiffness, and serve to dampen vibration. It will be realized that in those cases where they contribute to thermally induced stress and distortion in the sub-panel structure, they are accounted for in the subpanel thermoelastic distortion analysis.

The signal conductor patterns that make up the beam-forming and signal distribution networks on the interconnect substrates, and the interconnect substrates, per se, are configured such that access terminals for the signal distribution networks are located at edge portions of the interconnect substrates and are in proximity of input/output ports of the RF signal processing modules. A respective interconnect substrate may be sized to leave a gap or offset between an edge portion thereof containing the access terminals and the RF module retention slots.

These offsets may be sized to accommodate placement of transmission line 'jumper' boards between the access terminals of the printed wiring boards and RF amplifier module input/output ports that project upwardly through slots in the rear facesheet. Such transmission line jumper boards may additionally be used to support the RF modules installed in the slots in the honeycomb-configured support substrate. They also facilitate removal and repair of individual RF amplifier modules without having to remove the entire signal distribution interconnect substrate from the rear facesheet.

The input/output ports of the RF modules may be configured as 'wrap-around' metallizations projecting from the slots of the honeycomb support member in the same direction as the slot-orientation of the modules, so as to be generally orthogonal to the surface of the rear facesheet. Distal ends of the wrap-around metallizations are generally flat and parallel to the surface of the rear facesheet, thereby facilitating bonding of interconnect conductors—particularly ribbon-configured conductors.

Thus, to remove an RF module, it is only necessary to sever the ribbon bonding leads between the associated transmission line jumper board and the RF module, and then detach the jumper board, so as to uncover the module insertion slot and provide access to the RF module. The transmission line jumper board preferably has the same thickness as the interconnect substrate containing the signal distribution network, so that the section of microstrip on a top surface thereof is substantially coplanar with the microstrip conductor layers of the signal distribution network on the interconnect substrate—facilitating attachment of respective ends of a jumper ribbon connection.

A plurality of the antenna sub-panels described above may be integrated into a multi-radome structure, with each of the respective RF transmissive radome covers for the sub-panels being removably supported by way of a plurality of standoffs distributed among the antenna elements on the outer surface of the front facesheet. Such standoffs may include industry standard hook and loop attachment elements, so as to facilitate removably attaching the radome cover. The radome cover of a respective sub-panel serves to distribute thermal radiation gradients across and through the thickness of the sub-panel, and controls temperature extremes within the sub-panel—both of which are important to the antenna RF performance.

DETAILED DESCRIPTION

Figure 1:
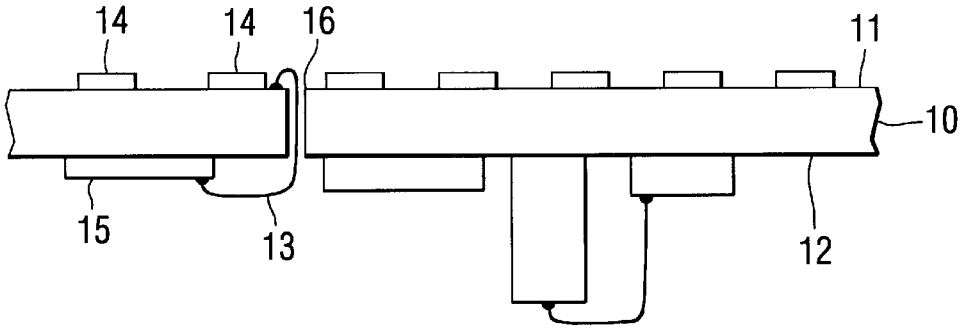
FIG. 1 PRIOR ART
FIG. 1 diagrammatically shows the general configuration of a conventional solid plate-configured antenna tile having a plurality of antenna elements mounted on one surface thereof, and associated RF signal processing and beam forming circuits mounted to a rear surface of the plate.
Figure 2:
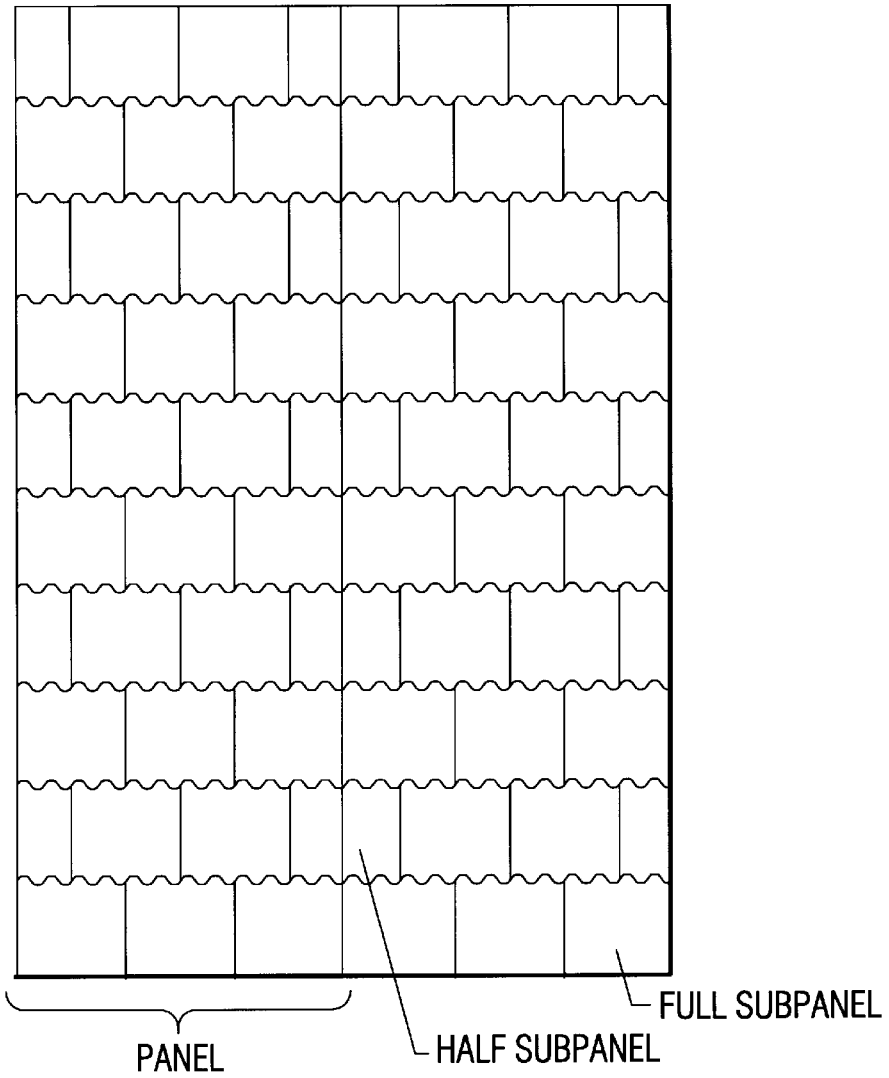
FIG. 2 PRIOR ART
FIG. 2 is a plan view of a plurality of joined-together antenna plates of FIG. 1.
Figure 3:
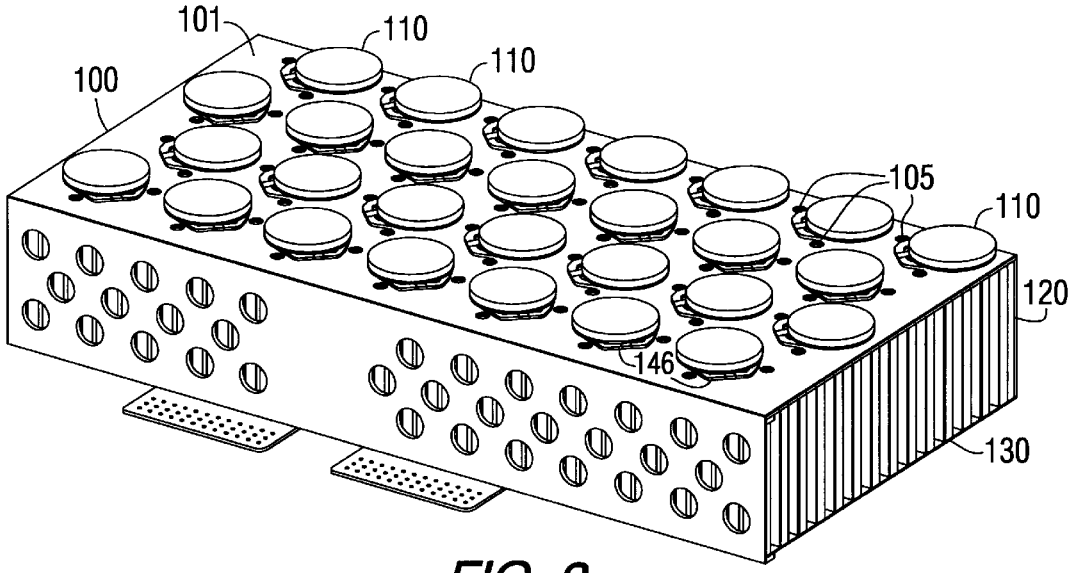
FIG. 3 is a diagrammatic perspective front facesheet view of a portion of a respective antenna sub-panel of the invention.
Figure 4:
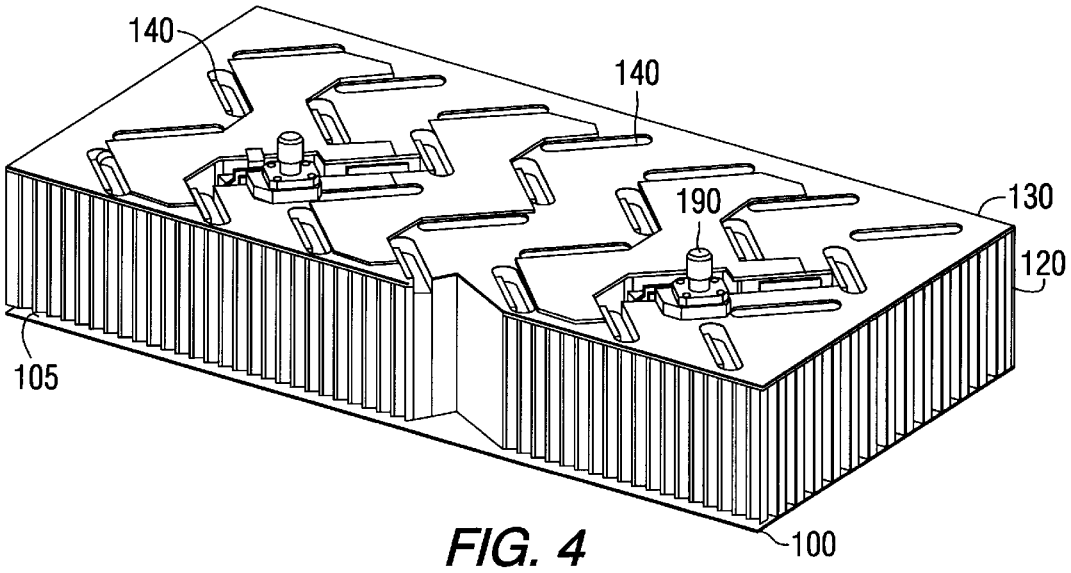
FIG. 4 is a diagrammatic perspective rear facesheet view of a portion of the antenna sub-panel of FIG. 3.
Figure 5:
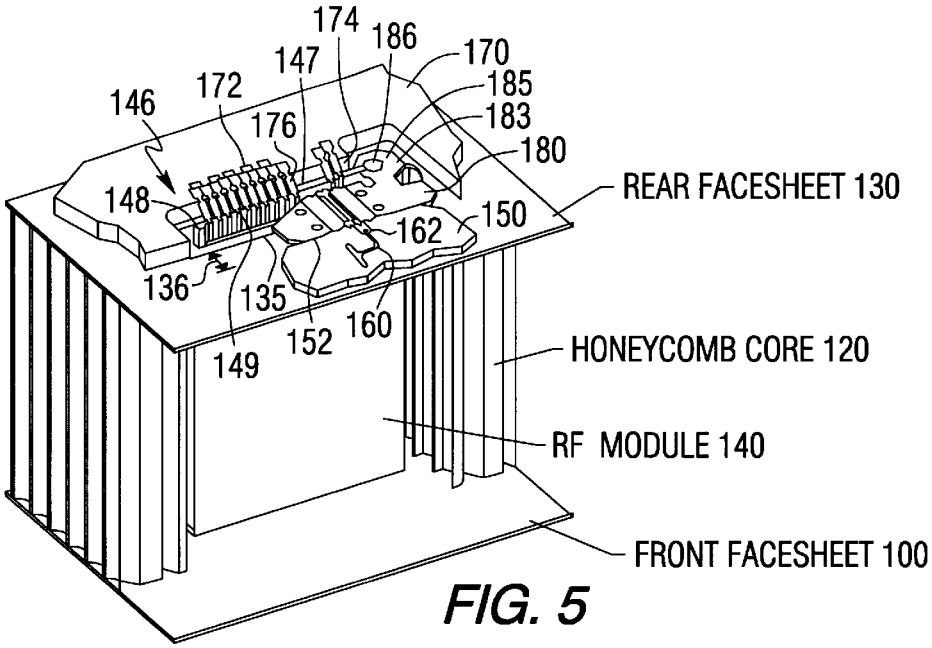
FIG. 5 is an enlarged partial perspective view of a rear facesheet of a respective antenna sub-panel of FIG. 3.
Figure 6:
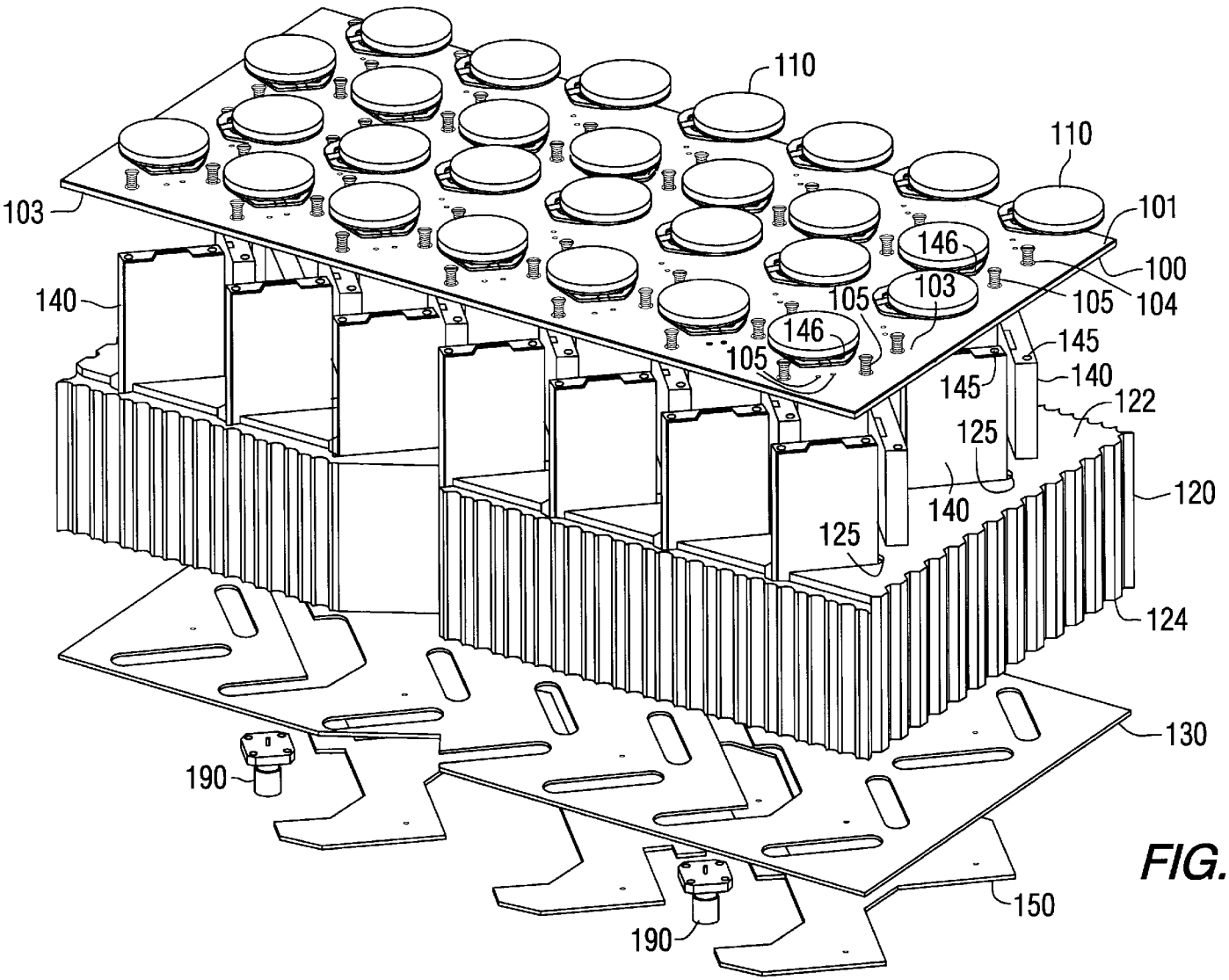
FIG. 6 is a diagrammatic perspective front facesheet exploded view of a portion of the respective antenna sub-panel illustrated in FIG. 3.
Figure 7:
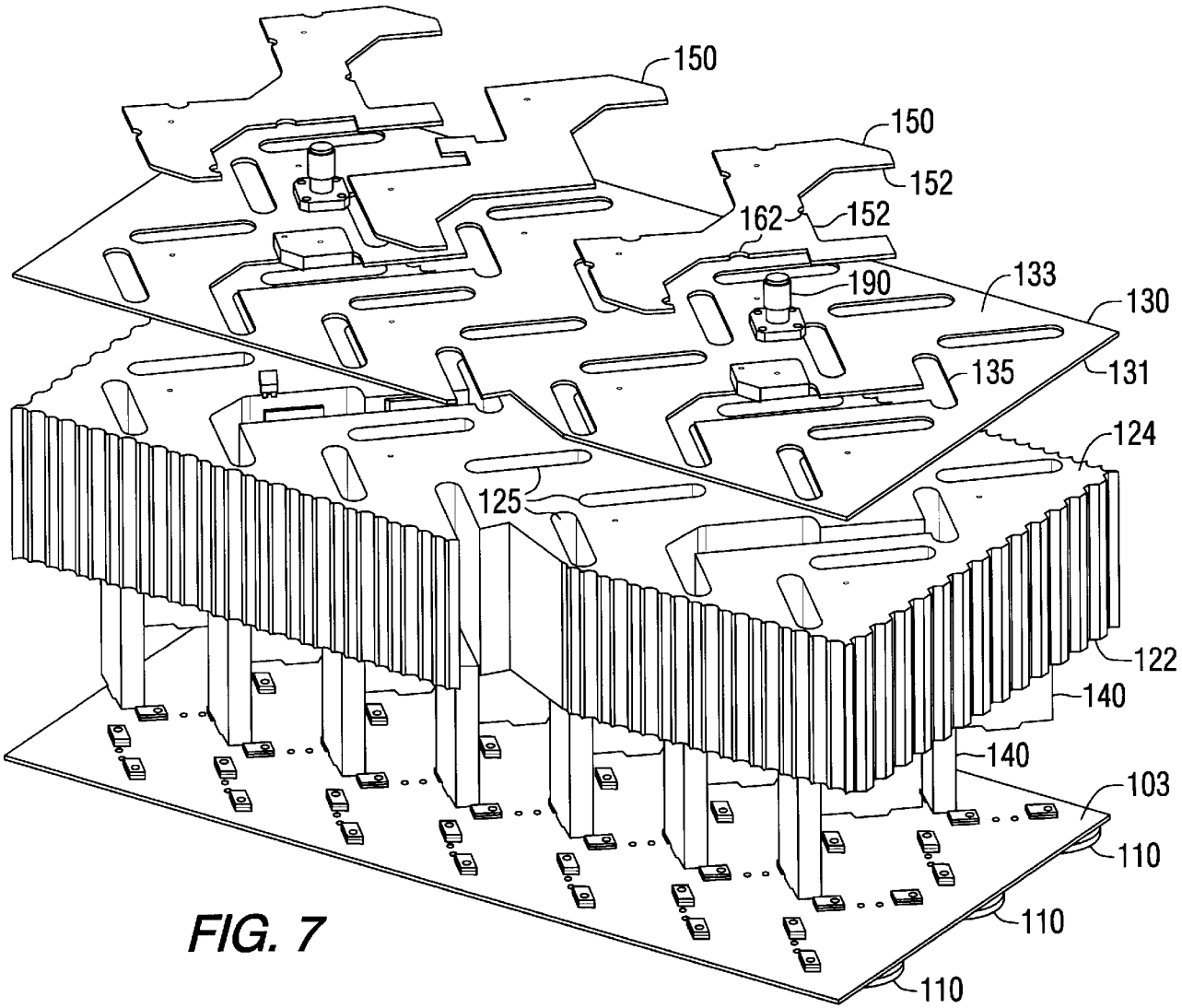
FIG. 7 is a diagrammatic perspective rear facesheet exploded view of a portion of the respective antenna sub-panel illustrated in FIG. 4.

FIGS. 3–7 diagrammatically illustrate the architecture of a respective laminate-configured antenna sub-panel of the present invention, such as may be used to implement an airborne or space-deployable antenna system. As a non-limiting example, the system may be a phased array antenna system. Within the illustrations of FIGS. 3–7, FIG. 3 is a diagrammatic perspective front facesheet view of a portion of a respective antenna sub-panel, FIG. 4 is a diagrammatic perspective rear facesheet view of a portion of a respective antenna sub-panel, FIG. 5 is an enlarged partial perspective view of a rear facesheet of a respective antenna sub-panel, FIG. 6 is a diagrammatic perspective front facesheet exploded view of a portion of a respective antenna sub-panel, and FIG. 7 is a diagrammatic perspective rear facesheet exploded view of a portion of a respective antenna sub-panel.

As shown therein, the general configuration of a respective antenna sub-panel is that of a laminate or 'sandwich' structure formed of a generally flat front facesheet 100, an intermediate support member 120, and a generally flat rear facesheet 130. The front facesheet 100 has an outer (radiation pattern direction-facing) surface 101, upon which a plurality (e.g., array) of antenna elements 110 are mounted (e.g., adhesively bonded). The front facesheet 100 also has a rear surface 103, which is adhesively bonded to a generally flat or planar outer surface 122 of the intermediate support member 120.

The front panel member 100 serves as both a support element and a ground plane for the antenna elements 110, and may be formed of a conductive plate (e.g., a solid plate of aluminum, brass, and the like), or a plate of non-conductive material having a conductive layer, such as a layer of copper, coated thereon. For purposes of providing a non-limiting example, the antenna elements 110 may comprise patch-configured antenna elements, such as a stub-tuned, proximity-fed, stacked patch antenna elements of the type described in co-pending U.S. patent application Ser. No. 08/781,542, entitled: "Stub-Tuned Proximity-Fed Stacked Patch Antenna," by J. Rawnick et al, filed on even date herewith, assigned to the assignee of the present application and the disclosure of which is herein incorporated.

As described in the Rawnick et al application, such a stub-tuned, proximity-fed, stacked patch antenna configuration is comprised of a 'stack' of different sized disc-shaped patch elements, that resonate at respectively different frequencies. One of the patch elements is an active element, being proximity-fed by a section of microstrip transmission line, while the other element is a parasitic or passive element, spaced apart from the active element. The microstrip proximity feed further includes an antenna tuning stub adjacent to the active patch element, that produces an additional resonant frequency in the vicinity of resonant frequency of the active patch and that of the parasitic/passive patch. The close proximity of the tuning stub to the stacked patch antenna causes electromagnetic field energy associated with the tuning stub to be coupled with the active and parasitic patch structure, causing the dual patch antenna to exhibit an additional radiating mode, thereby creating a distributed resonance characteristic, that is a composite of the three components, and having an augmented bandwidth compared with that of a conventional patch antenna.

As described earlier, in accordance with the present invention, the intermediate support member 120 is preferably configured as a generally hollow, honeycomb 'backbone' structure, which results in a very low weight density (on the order of only two pounds per cubic foot,—nearly two orders of magnitude lighter than that of a conventional aluminum plate architecture). By generally hollow is meant that a given volume within the support member 120 is mostly empty of the material of which the member 120 is made (e.g., aluminum ribbing), and instead contains only free space between the material of the (honeycomb) ribs.

As a non-limiting example, for the case of a honeycomb structure having a hexagonal rib geometry, the spacing between opposite ribs or walls of a respective honeycomb hexagonal tube may be on the order of sixty to five hundred mils, while the thickness of a respective rib or wall that defines the sides of the hexagonal tube may be on the order of only one nil. Thus, the honeycomb structure is mostly hollow, with only the relatively thin (one mil thick) honeycomb ribs being made of a material that imparts weight to the structure. However, because of the honeycomb geometry and the bonding of the front and rear facesheets to the opposite sides of the honeycomb structure, what results is effectively a self-supporting, laminate or 'sandwich' sub-panel that is both relatively stiff and thermally stable.

As a result, the sub-panel architecture of the invention provides a very stable flatness at each of the opposite parallel surfaces 122 and 124 of the honeycomb-configured backbone support member 120. Maintaining a thermally stable flatness of its radiation front surface 122 is of major importance, as it prevents unacceptable sidelobes from being induced in the radiation pattern of the antenna element array distributed on front facesheet 100.

The thickness of the honeycomb-configured support member 120 is sized in accordance with the lengths of RF signal processing modules 140, which are retained in respective slots 125 between the honeycomb support member's front and rear surfaces 122 and 124. As a consequence of this size mutuality, input/output ports at opposite ends of the RF modules 140 are substantially coplanar with transmission line conductor traces one the front and rear facesheets 100 and 130, thereby substantially minimizing signal interconnection distances at the input/output ports of the RF modules 140 with the antenna elements 110 and signal processing components on the respective facesheets, so as to optimize impedance matching and minimize RF module insertion loss. Namely, the RF modules 140 provide the functionality of RF feed-throughs for RF signal coupling connections between the rear and front facesheets of a respective antenna sub-panel.

As described previously, installing the RF signal processing modules 140 within the intermediate support structure 120 between the front or outer, antenna element panel 100 and the inner or rear beam forming network panel 130 results in a highly compact, integrated architecture, that is readily joined with other like panel laminate structures, to realize an overall antenna spacial configuration that defines a prescribed antenna aperture.

The slots 125 in the honeycomb-configured support member 120 may be formed, for example, by milling, so that the slots 125 are arrayed in correspondence with the locations of the antenna elements 110 on the front surface of front facesheet 100. To retain the RF modules 140 in the slots 125, front panel member 100 may include a plurality of holes 104, which are sized to receive screws 105 that engage tapped bores 145 in the RF modules 140. The RF modules 140 further include antenna feed terminals 146, which extend through associated holes 106 in the front panel member 100 for electrical connection with antenna feed terminals of the antenna elements 110.

As pointed out supra, such RF module-to-facesheet conductor interconnects, as well as other electrical connections for the panel members of the antenna structure, including transmission line jumper board connections at the rear panel member 130, to be described, may be effected by means of ribbon bond connections, such as those provided in the system level-associated, thermosonic ribbon bonding process described in the Beck et al application.

Pursuant to the thermosonic ribbon bonding process described in the Beck et al application, the respective bonding sites of the antenna sub-panels are maintained at a relatively low temperature, preferably in a range of from 25° C. to 85° C., so as to avoid altering the design parameters of system circuit components, especially the characteristics of the circuits within the RF modules 140 that are retained within the slots 125 of the intermediate honeycomb-configured support member 120. To achieve the requisite atomic diffusion bonding energy, without causing fracturing or destruction of the ribbon or its interface with the low temperature bond sites, the vibrational frequency of the ultrasonic bonding head is increased to an elevated ultrasonic bonding frequency above 120 KHz (preferably in a range of from 122 KHz to 140 KHz).

Figure 8:
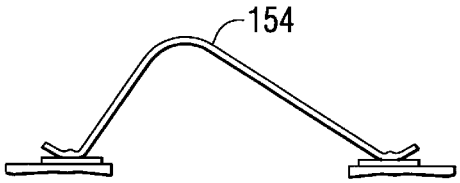
FIG. 8 is a side view of a ribbon bond formed between an input/output terminal of an RF module and an adjacent facesheet conductor.

As shown in FIG. 8, which is a side view of a ribbon bond formed between an input/output terminal of an RF module 140 and an adjacent facesheet conductor, a respective ribbon bond connection 154 preferably has a slight arched contour, which enables the ribbon connection to absorb both thermal and vibrational loads, while affording the requisite impedance matching properties for RF interconnect.

The combination of low bonding site temperature, high ultrasonic frequency and ribbon configured interconnect material makes it possible to not only perform thermosonic bonding between metallic sites that are effectively located in the same (X-Y) plane, but between bonding sites that are located in somewhat different planes, namely having a measurable orthogonal (Z) component therebetween. As a result, 'L'-bent ribbon connections are readily bonded (thermosonically) between microstrip feeds of the stacked patch antenna elements 110 and signal feed terminals of the RF modules 140 or between antenna elements and its supporting front facesheet.

The rear facesheet 130 has an interior surface 131 which, like the attachment of the rear surface 103 of front facesheet 100 to the front surface 122 of honeycomb member 120, is adhesively bonded attached to the rear surface 124 of member 120. Rear facesheet 130 also has an outer (signal distribution, power and control network-supporting) surface 133, to which are bonded a plurality of interconnect substrates (e.g., printed wiring boards) 150, containing beam-forming and signal distribution networks 160, and additional (multilayer) interconnect substrates 170, which contain DC power and digital control links.

The interconnect patterns that make up the beam-forming and signal distribution networks 160 on the interconnect substrates 150, and the interconnect substrates 150 themselves are configured such that access terminals 162 for the signal distribution networks may be located at selected edge portions 152 of the interconnect substrates 150, and in proximity of input/output ports of the RF signal processing modules 140. Although the interconnect substrates 150 may be sized and configured such that the access terminals 162 are located immediately adjacent to input/output ports of the RF signal processing modules 140 that have been inserted into slots 125 in the honeycomb support member 120, it is preferred that the interconnect substrates 150 are sized to leave a gap or offset 136 between edge portions 152 thereof containing the access terminals 162 and the slots 125.

As shown in FIG. 5, this offset 136 serves to accommodate the placement of a respective transmission line 'jumper' board 180 between access terminals 162 of the interconnect substrate 150 and input/output ports 146 of the RF modules 140 that project upwardly from the RF modules through slots 135 in the rear facesheet 130. As will be described, the use of transmission line jumper boards 180 facilities removal and repair of an individual RF module 140 from the intermediate honeycomb support member 120, without having to remove the entire signal distribution interconnect substrate 150 from the rear facesheet 130.

The input/output port 146 of a respective module 140 may be configured as layers of 'wrap-around' metallizations 147 formed on insulator material 148 projecting slightly outwardly from the slots 125 of the intermediate, honeycomb-configured support member substrate 120 in a direction of orientation of the RF signal processing modules 140, so as to be generally perpendicular or orthogonal to the surface of the rear facesheet 130. Distal ends 149 of the wrap-around metallizations 147 are generally flat and parallel to the surface of the rear panel member so as to facilitate bonding of interconnect conductors therebetween, particularly ribbon-configured interconnect, as will be described.

As pointed out above, by orienting the RF modules 140 generally transverse to the front and rear facesheets, and making the thickness of the intermediate honeycomb member 120 substantially equal to the lengths of the RF modules, the input/output port connections of the RF modules 140 at opposite ends thereof can be located in substantially the same plane as the interconnect traces on the front and rear facesheets, where the antenna array and the beam-forming circuits, respectively, are disposed. In particular, coplanar locations of the input/output ports 146 at the opposite ends of the modules 140 with the microstrip conductor traces that make up the antenna feeds on the front facesheet 100, and the beam-forming patterns on the rear facesheet 130, serve to reduce the RF interconnect distances between components, thereby minimizing insertion loss, facilitating RF impedance matching, thus improving system performance.

The slots 135 in the rear panel member 130 are sized and located to conform with the slots 125 in the intermediate honeycomb-configured backbone member 120, so as to facilitate insertion and removal of a respective RF module 140 from a respective slot 125. As shown in the enlarged partial view of FIG. 5, a respective transmission line jumper board 180 is preferably dimensioned so as to extend from immediately adjacent to an edge portion 152 of an interconnect substrate 150, and over a slot 125, immediately adjacent to generally flat distal end portions 149 the wrap-around metallizations 147 of an input/output port 146 of a respective RF module 140. A slot-overlapping portion 183 of the jumper board 180 may also include an aperture 185 sized to receive a fitting 186, such as a threaded screw, that engages a corresponding bore in the RF module 140, and serves to further mechanically strengthen the laminate structure of the sub-panel, as its secures the RF module 140 within its slot 125. Alternatively, a drop of adhesive (epoxy) my be used.

As a result, in order to remove an RF module 140, it is only necessary to sever the ribbon bonds to the associated transmission line jumper board 180 that partially extends over the slot 125 in which that RF module is installed, and then detach the transmission line jumper board 180, so as to uncover the slot 125 and provide access to the RF module.

The transmission line jumper board 180 is preferably of the same thickness as the interconnect substrate 150 containing the RF signal distribution network 160, so that the section of microstrip 182 on a top surface 184 thereof is effectively coplanar with the microstrip conductor layers of the signal distribution network 160 on the interconnect substrate 150, thereby facilitating attachment of respective ends of a 'jumper' ribbon bond connection between the two. As noted previously, such a ribbon bond jumper connection may be effected by the ribbon bond process described in the above-referenced Beck et al application, whether the connection is coplanar having metallic bonding sites located in the same (X-Y) plane, as are the microstrip of the jumper board 180 and the conductors of the RF signal distribution network of the interconnect substrate 150, but between bonding sites that are located in somewhat different planes, namely having a measurable orthogonal (Z) component therebetween.

As a non-limiting example of such vertically offset bonding sites, FIG. 5 diagrammatically illustrates bonding terminals 172 for DC power and digital control links of an increased thickness, multilayer interonnect substrate (printed wiring board) 170. Bonding terminals 172 are located along an edge portion 174 of the board, which is adjacent to, but does not overlap slot 135 in rear facesheet 130. The multilayer printed wiring board 170 is thicker than the microstrip jumper board 180, so that bonding terminals 172 are slightly vertically offset from the distal ends 149 of the wrap-around metallizations 147 of which the input/output port 146 of a respective RF module 140 is configured.

Since the bonding pads 172 of the multilayer printed wiring board 170 are proximate to the generally flat distal end portions 149 of the wrap-around metallizations 147 of the modules 140, conductively bridging the slight Z-axis offset therebetween is readily accomplished ribbon connections 176 formed by the thermosonically bonded ribbon process of the Beck et al application, referenced above. To provide external signal-coupling access to the signal distribution networks 160 on interconnect substrate 150, RF coaxial connectors 190 are employed.

Figure 9:
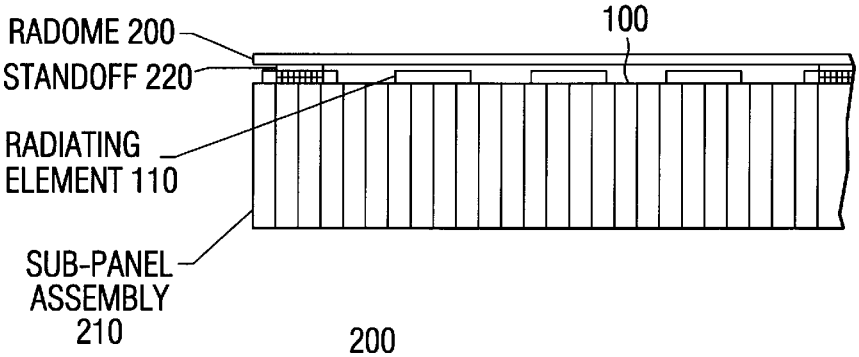
FIG. 9 diagrammatically illustrates a radome removably attached to the front facesheet of a sub-panel of the present invention.
Figure 10:
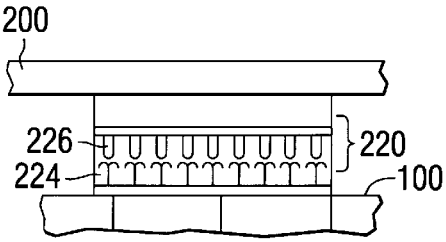
FIG. 10 diagrammatically illustrates a hook and loop standoff attachment employed in the radome architecture of FIG. 9.

As described briefly above, a plurality of the antenna sub-panels detailed with reference to FIGS. 3–8 may be integrated or nested together into a multi-radome structure, an individual one of which diagrammatically illustrated in FIGS. 9 and 10. In particular FIG. 9 diagrammatically illustrates an RF transmissive radome 200 that is removably attached to the front facesheet 100 of a sub-panel laminate assembly 210. The RF transmissive radome cover 200 is removably supported by way of a plurality of standoffs 220 distributed among the antenna elements 110 on the outer surface of the front facesheet. As shown diagrammatically in FIG. 10, the standoffs 220 may include industry standard hook and loop attachment elements 224 and 226, so as to facilitate removably attaching the radome cover 200 to an overall assembly of adjoining sub-panels. The radome cover 200 of a respective sub-panel serves to distribute thermal radiation gradients across and through the thickness of the sub-panel, and controls temperature extremes within the sub-panel—both of which are important to the antenna RF performance.

As will be appreciated from the foregoing description, pursuant to the present invention, the previously described deficiencies of conventional solid plate-based antenna architectures are effectively overcome by the lightweight laminate antenna sub-panel architecture of the present invention, in which RF signal processing modules are embedded within a honeycomb-configured support member, upon which respective antenna sub-array and control, power and beam steering signal distribution networks are respectively mounted. By sizing the thickness of the intermediate support member such that input/output ports at opposite ends of the RF modules are substantially coplanar with the conductor traces on the front and rear facesheets of the sub-panel, the RF modules themselves provide the functionality of RF feed-throughs to provide RF signal coupling connections between the rear and front facesheets of the antenna sub-panel. This reduces the RF interconnect distances between components, thereby minimizing insertion loss, facilitating RF impedance matching, and improving system performance.

While we have shown and described an embodiment in accordance with the present invention, it is to be understood that the same is not limited thereto but is susceptible to numerous changes and modifications as known to a person skilled in the art, and we therefore do not wish to be limited to the details shown and described herein but intend to cover all such changes and modifications as are obvious to one of ordinary skill in the art.

What is claimed:

1. An antenna architecture having a plurality of joined-together laminate-configured sub-panels, a respective laminate-configured sub-panel comprising:

a first, generally flat facesheet having a first surface which supports a plurality of antenna elements and feed conductors therefor;

a second, generally flat facesheet having a first surface which supports a signal distribution network for said plurality of antenna elements;

a facesheet support structure having first and second sides that are generally parallel to one another and supporting thereon said first and second facesheets, respectively; and a plurality of RF signal processing circuit modules arranged in said facesheet support structure in a direction that is generally orthogonal to said first and second sides thereof, and having first signal-coupling ports thereof located in proximity of said feed conductors of said antenna elements supported on said first surface of said first facesheet, and second signal-coupling ports thereof located in proximity of conductors of said signal distribution network supported on said first surface of said second facesheet; and wherein said signal distribution network comprises:

a first substrate containing a first signal distribution network for coupling to said signal processing modules, and being supported on a first location of said first surface of said second facesheet that is spaced apart from said second signal-coupling ports of said signal processing modules, and a plurality of second substrates containing signal coupling links and being supported at a second location of said first surface of said second facesheet that is between said first location and said second signal-coupling ports of said signal processing modules, and conductors joining said coupling links of said plurality of second substrates with said second signal-coupling ports of said signal processing modules, and joining said coupling links of said plurality of second substrates with conductors of said first signal distribution network on said first substrate.

2. An antenna architecture according to claim 1, wherein said coupling links of said plurality of second substrates are generally coplanar with conductors of said first signal distribution network on said first substrate.

3. An antenna architecture according to claim 2, wherein said coupling links of said plurality of second substrates are generally coplanar with said second signal-coupling ports of said signal processing modules.

4. An antenna architecture according to claim 3, wherein said conductors join said coupling links of said plurality of second substrates with said second signal-coupling ports of said signal processing modules, and join said coupling links of said plurality of second substrates with conductors of said first signal distribution network on said first substrate comprise ribbon conductors.

5. An antenna architecture according to claim 3, wherein said first and second signal-coupling ports comprise wrap around metalizations formed on insulator material extending in a direction of orientation of said signal processing circuit modules arranged within said facesheet support structure, said wrap around metalizations including respective portions that are generally parallel to said first and second surfaces of said first and second facesheets, and wherein said conductors are joined between said coupling links of said second substrates and said respective portions of said metalizations that are generally parallel to said first and second surfaces of said first and second facesheets.

6. An antenna architecture according to claim 1, wherein said second substrates are removably attached to said signal processing circuit modules, to provide mechanically strength to said antenna architecture.

7. A method of manufacturing an antenna architecture comprising the steps of:

(a) providing a support structure having first and second sides that are generally parallel to one another and are spaced apart from one another by a distance proximate the length of signal processing circuit modules;

(b) attaching a first, generally flat facesheet having a first surface which supports a plurality of antenna elements and feed conductors therefor to a first side of said support structure, and attaching a second, generally flat facesheet having a first surface which supports a signal distribution network for said plurality of antenna elements to a second side of said support structure;

(c) installing a plurality of said signal processing circuit modules in said support structure in a direction that is generally transverse to said first and second sides thereof, such that first signal-coupling ports thereof are located in proximity of said feed conductors of said antenna elements supported on said first surface of said first facesheet, and second signal-coupling ports thereof are located in proximity of conductors of said signal distribution network supported on said first surface of said second facesheet; and (d) providing connections between said first signal-coupling ports of said signal processing circuit modules and said feed conductors of said antenna elements, and between second signal-coupling ports of said signal processing circuit modules and said signal distribution network, and wherein said signal distribution network supported on said second facesheet comprises a first substrate containing a first signal distribution network for coupling to said signal processing modules, and being supported on a first location of said first surface of said second facesheet that is spaced apart from said second signal-coupling ports of said signal processing circuit modules, and a plurality of second substrates containing signal coupling links and being supported at a second location of said first surface of said second facesheet that is between said first location and said second signal-coupling ports of said signal processing circuit modules, and wherein step (d) comprises conductively joining said coupling links of said plurality of second substrates with said second signal-coupling ports of said signal processing circuit modules, and conductively joining said coupling links of said plurality of second substrates with conductors of said first signal distribution network on said first substrate.

8. A method according to claim 7, wherein said coupling links of said plurality of second substrates are generally coplanar with conductors of said first signal distribution network on said first substrate.

9. A method according to claim 8, wherein said coupling links of said plurality of second substrates are generally coplanar with said second signal-coupling ports of said signal processing modules.

10. A method according to claim 9, wherein step (d) comprises conductively joining said coupling links of said plurality of second substrates with said second signal-coupling ports of said signal processing circuit modules, and conductively joining said coupling links of said plurality of second substrates with conductors of said first signal distribution network on said first substrate comprise ribbon conductors.

11. A method according to claim 9, wherein of said first and second signal-coupling ports comprise wrap around metalizations formed on insulator material extending in a direction of orientation of said signal processing circuit modules arranged within said support structure, said wrap around metalizations including respective portions that are generally parallel to said first and second surfaces of said first and second facesheets, and wherein said conductors are joined between said coupling links of said second substrates and said respective portions of said metalizations generally parallel to said first and second surfaces of said first and second facesheets.

12. A method according to claim 7, wherein said second substrates are removably attached to said signal processing circuit modules, to provide mechanically strength to said antenna architecture.

13. An antenna architecture comprising:

a first facesheet having a first surface supporting a plurality of antenna elements;

a second facesheet having a first surface upon which a signal distribution network for said plurality of antenna elements is supported;

a support member arranged between and supporting said first and second facesheets in generally spaced apart parallel relationship; and a plurality of signal processing circuit modules contained within said support member between said first and second facesheets, and having first signal-coupling ports located in proximity of said first surface of said first facesheet, and second signal-coupling ports located in proximity of said first surface of said second facesheet, said second signal-coupling ports comprising metalizations having surface portions that are generally parallel to said first surface of said second facesheet; and wherein said signal distribution network supported on said first surface of said second facesheet comprises a first substrate containing a first signal distribution network for coupling to said signal processing circuit modules, and being supported on a first location of said first surface of said second facesheet that is spaced apart from said second signal-coupling ports of said signal processing circuit modules, and a plurality of second substrates supported at a second location of said first surface of said second facesheet that is between said first location and said second signal-coupling ports of said signal processing circuit modules, containing signal coupling links having surfaces that are generally parallel to said surface portions of said metalizations of said second signal-coupling ports of said signal processing circuit modules, and are generally parallel to the surface of conductor material of said first signal distribution network of said first substrate, and conductors joining said coupling links of said plurality of second substrates with said metalizations of said second signal-coupling ports of said signal processing circuit modules, and joining said coupling links of said plurality of second substrates with said conductor material of said first signal distribution network on said first substrate.

14. An antenna architecture according to claim 13, wherein said conductors joining said coupling links of said plurality of second substrates with said metalizations of said second signal-coupling ports of said signal processing circuit modules, and joining said coupling links of said plurality of second substrates with said conductor material of first signal distribution network on said first substrate comprise ribbon conductors.

15. An antenna architecture according to claim 14, wherein said ribbon conductors comprise thermosonically bonded ribbon conductors.

16. An antenna architecture according to claim 13, wherein said plurality of signal processing circuit modules are oriented within said support member so as to be generally orthogonal to said first and second facesheets, and wherein said first and second signal-coupling ports comprise wrap around metalizations formed on insulator material extending in a direction of orientation of said signal processing circuit modules as supported within said support structure between said first and second facesheets, said wrap around metalizations including first metalization portions that are generally orthogonal to said first surface of said first facesheet, and second metalization portions that are generally parallel to said first surface of said second facesheet.

17. An antenna architecture according to claim 13, wherein said first signal-coupling ports terminate adjacent to feed conductors of said antenna elements supported on said first surface of said first facesheet.

18. An antenna architecture according to claim 13, wherein said second substrates are removably attached to said signal processing circuit modules, to provide mechanically strength to said antenna architecture.

19. A signal interconnection architecture comprising:

a support member having a surface upon which a signal distribution network is supported; and a signal processing circuit module supported adjacent to said support member and having first signal-coupling ports located in proximity of said surface of said support member, and comprising metalizations that are generally parallel to said surface of said support member; and wherein said signal distribution network comprises a first substrate containing a first signal distribution network for coupling to said signal processing circuit module, and being supported on a first location of said surface of said support member that is spaced apart from said signal-coupling ports of said signal processing circuit module, a second substrate supported at a second location of first surface of said support member that is between said first location and said second signal-coupling ports of said signal processing circuit module, and containing signal coupling links lying in surfaces that are generally parallel to surfaces of said metalizations of said second signal-coupling ports of said signal processing circuit module, and are generally parallel to surfaces of conductor material of said first signal distribution network of said first substrate, and conductors joining said coupling links of said second substrate with said metalizations of said signal-coupling ports of said signal processing circuit module, and joining said coupling links of said second substrate with said conductor material of said first signal distribution network on said first substrate.

20. A signal interconnection architecture according to claim 19, wherein said conductors comprise ribbon conductors.

21. A signal interconnection architecture according to claim 19, wherein said signal-coupling ports comprise wrap around metalizations formed on insulator material extending in a direction of orientation of said signal processing circuit module as supported adjacent to said support member, said wrap around metalizations including metalization portions that are generally parallel to said surface of said support member.

22. A signal interconnection architecture according to claim 19, wherein said second substrate is removably attached to said signal processing circuit modules, to provide mechanically strength to said signal interconnection architecture.

* * * * *